US007270059B2

(12) United States Patent
Roller et al.

(10) Patent No.: US 7,270,059 B2
(45) Date of Patent: Sep. 18, 2007

(54) DEVICE FOR THE ELECTRICAL INITIATION OF A PYROTECHNIC MICROCHARGE, AND MICROSYSTEM USING SUCH A DEVICE

(75) Inventors: Denis Roller, La Ferte Alais (FR); Patrick Broyer, Beynost (FR); Bruno Colin, Marcy l'Etoile (FR)

(73) Assignees: SNPE Materiaux Energetiques, Paris (FR); bioMerieux, Marcy l'Etoile (FR)

( * ) Notice: Subject to any disclaimer, the term of this patent is extended or adjusted under 35 U.S.C. 154(b) by 0 days.

(21) Appl. No.: 10/552,583

(22) PCT Filed: Apr. 9, 2004

(86) PCT No.: PCT/FR2004/000882

§ 371 (c)(1),
(2), (4) Date: Oct. 12, 2005

(87) PCT Pub. No.: WO2004/094935

PCT Pub. Date: Nov. 4, 2004

(65) Prior Publication Data

US 2006/0096486 A1 May 11, 2006

(30) Foreign Application Priority Data

Apr. 16, 2003 (FR) ..... 03 04764

(51) Int. Cl.
*F42B 3/10* (2006.01)

(52) U.S. Cl. ..... 102/202.5; 102/202.9

(58) Field of Classification Search ..... 102/205.5, 102/202.9, 202.11, 205
See application file for complete search history.

(56) References Cited

U.S. PATENT DOCUMENTS

| | | | | |
|---|---|---|---|---|
| 3,820,461 | A | 6/1974 | Silvia | |
| 5,123,355 | A * | 6/1992 | Hans et al. | 102/202 |
| 6,105,503 | A * | 8/2000 | Baginski | 102/202.5 |
| 6,155,171 | A * | 12/2000 | Haegeman et al. | 102/202.9 |
| 6,994,030 | B2 * | 2/2006 | Perut et al. | 102/202.5 |

FOREIGN PATENT DOCUMENTS

| | | |
|---|---|---|
| GB | 273338 | 12/1927 |
| GB | 951620 | 3/1964 |
| GB | 1252984 | 11/1971 |
| WO | WO 02/088551 A1 | 11/2002 |

OTHER PUBLICATIONS

U.S. Appl. No. 10/559,454, filed Dec. 5, 2005, Broyer et al.

* cited by examiner

*Primary Examiner*—Michael J. Carone
*Assistant Examiner*—Benjamin P. Lee
(74) *Attorney, Agent, or Firm*—Oliff & Berridge, PLC

(57) ABSTRACT

The invention relates to a device for the electrical initiation of at least one pyrotechnic microcharge (3), this device being characterized in that it comprises a support element having at least one conductive finger (6) connected to a first terminal of a central control unit (8), a second terminal of said central control unit (8) being intended to be electrically connected to an electrically conductive support for the pyrotechnic microcharge (3). The invention also relates to a microactuator (1, 1*a*, . . . , 1*h*) and a microsystem (1') that use such an initiation device.

18 Claims, 3 Drawing Sheets

DEVICE FOR THE ELECTRICAL INITIATION OF A PYROTECHNIC MICROCHARGE, AND MICROSYSTEM USING SUCH A DEVICE

The technical field of the invention is that of microactuators intended to fulfill mechanical, chemical, electrical, thermal or fluidic functions in microsystems, for microelectronic applications such as chips, or biomedical applications such as analysis cards that integrate the microfluidics, or for chemical synthesis, such as microreactors.

The technical field of the invention is more particularly that of devices for initiating microactuators included in a microsystem.

BACKGROUND

The microactuators are miniaturized objects produced in solid supports that may be semiconductors or insulators, for the purpose of forming microsystems such as, for example, microvalves or micropumps in fluid microcircuits, or microswitches in electronic microcircuits.

Microactuators using electrostatic, piezoelectric, electromagnetic and bimetallic effects have already existed for quite a long time. A new generation of microactuators is starting to appear, namely those using a pyrotechnic effect. Pyrotechnic materials have a high energy density, and their use in microactuators therefore makes it possible for the dimensions of microsystems incorporating such microactuators to be considerably reduced. Such pyrotechnic microactuators are described for example in patent application WO 02/088551.

As is known, a pyrotechnic microactuator is operated by causing the combustion of a pyrotechnic microcharge, generally by locally raising its temperature up to a decomposition threshold by means of an initiation device. There may be a large number of microactuators integrated into the same microsystem, for example several hundred microactuators. Since each microactuator possesses its own initiation device, the question arises as how to individually address each of the microactuators. The system for individually initiating each of the microactuators may be entirely integrated into the microsystem. However, the microsystem therefore becomes much more complex. In addition, it should be recalled that a pyrotechnic microactuator operates in "single shot" mode, the combustion of a pyrotechnic microcharge being irreversible. The application of such pyrotechnic microactuators will therefore be implemented as a general rule in consumable products that are used only once. In order for such single-use products to be commercially viable they will therefore have to have a relatively low manufacturing cost. The use of an initiation device integrated into the microsystem will therefore not only make the final product complex, but it will also considerably increase its manufacturing cost.

SUMMARY

The object of the invention is therefore to obtain a device for individually initiating each of the pyrotechnic microcharges within a plurality of pyrotechnic charges, which is simple, standard, independent and easily able to be fitted onto a support for the pyrotechnic microcharges.

This object is achieved by a device for the electrical initiation of at least one pyrotechnic microcharge, this device being characterized in that it comprises a support element having at least one electrically conductive portion connected to a first terminal of a central control unit, a second terminal of said central control unit being intended to be electrically connected to an electrically conductive support, the microcharge being located at a sufficient distance from the conductive support to be able to be ignited by localized heating of the support, this heating being carried out via the conductive portion placed in contact with the conductive support, just beneath the pyrotechnic microcharge.

According to a first embodiment, the pyrotechnic microcharge is deposited on the conductive support.

According to a second embodiment, the pyrotechnic microcharge is separated from the support by at least one thermally conductive layer.

For example, a pyrotechnic microcharge will have the form of a discoid film with a thickness of between 1 μm and 100 μm. The mass of a pyrotechnic microcharge will for example be 0.5 μg. The conductive portion of the support element, used to initiate the microcharge, must be of a size similar to that of the microcharge.

According to one feature, the conductive portion is produced at least at the top of a finger, said finger being positioned so as to bear via its top against the conductive support, just under the pyrotechnic microcharge.

According to one embodiment, the finger is mounted on a spring. Thus, the finger is kept in contact with the electrically conductive support.

According to one feature, the finger is an electrode made of carbon or made of titanium.

According to another embodiment, the finger consists of a boss made of flexible material formed on the support element.

According to one feature, the support element consists of a thermoformed sheet of flexible material from which said boss is formed, the boss thus forming a finger intended to bear via its top against the conductive support.

In a preferred embodiment of the initiation device according to the invention, when the support element comprises a plurality of fingers, for example identical fingers, the electrically conductive portions are connected in parallel to the first terminal of the central control unit. According to the invention, a "hedgehog" of fingers is created in the support element. Each of the fingers bears against the conductive support and is intended to be placed beneath a pyrotechnic microcharge deposited directly or indirectly on the conductive support depending on one of the configurations described above, in order to be able to ignite it upon receiving a command from the central control unit. It is thus possible to initiate a plurality of pyrotechnic microcharges from a single initiation device. Preferably, the central control unit may have selection means so as to be able to select the microcharges to be initiated by making the current flow through the conductive portion of only certain fingers.

According to one feature, when the support element comprises a plurality of fingers, the position of the fingers on the support element can be adjusted. In this way, it will be possible to adapt the position of the fingers to the position of the pyrotechnic microcharges on the support. A single support element may therefore be used, whatever the position of the microcharges to be initiated on the support.

The invention also relates to a microactuator comprising an actuating element that can be actuated by the gases emanating from the combustion of a pyrotechnic microcharge, this microactuator being characterized in that said microcharge is located at a sufficient distance from a conductive layer to be able to be ignited by localized heating using an initiation device in accordance with that describe above, in which an electrically conductive portion is placed on said pyrotechnic microcharge so as to bear against the conductive layer, just beneath said pyrotechnic microcharge.

According to one feature of this microactuator, the pyrotechnic microcharge is deposited on a face of the conductive layer and the conductive portion of the initiation device is in contact with the face of the conductive layer on the opposite side to that on which the pyrotechnic microcharge is deposited.

According to another feature, the conductive layer consists of a metal film, for example one made of aluminum.

According to another feature, the aluminum film has a thickness of between 20 and 150 μm. The thickness of the conductive layer varies according to the intensity of the current through the conductive layer and according to the time that this current is flowing through said layer.

According to another feature, the aluminum film has a thickness of 70 μm.

According to another feature, the microactuator is produced by an assembly of superposed layers.

According to another feature, the microactuator includes a cavity or chamber formed by the multilayer assembly, in which cavity or chamber at least one pyrotechnic microcharge is placed, said cavity being closed by a layer constituting a deformable membrane. Preferably, the cavity is circular and has a diameter of 1 mm.

The invention also relates to a microsystem. This microsystem is characterized in that it comprises a support for a plurality of adjacent microactuators in accordance with that described above, the microcharges of the microactuators being located at a sufficient distance from a conductive layer to be able to be ignited, each independently, by heating using the initiation device described above whose support element is fitted onto the support for the microactuators, said initiation device comprising a plurality of conductive portions connected in parallel to the first terminal of the central control unit, a conductive portion being placed on each of the pyrotechnic microcharges, in contact with the conductive layer, just beneath each of the pyrotechnic microcharges.

According to a preferred embodiment, the microsystem consists of an assembly of superposed layers. The microactuators are all formed from the assembly of these same layers. A central layer has a plurality of holes and is covered on each of its faces with a layer so that each of the holes thus forms a closed cavity. At least one pyrotechnic microcharge is placed in each of the cavities. One of the covering layers for example consists of a deformable membrane constituting an actuating element common to all the microactuators. This membrane therefore deforms at the places where microactuators are in operation.

Thus, according to the invention, this allows the microsystem to be considerably simplified, by making it independent of its initiation device. According to the invention, after the pyrotechnic microcharges of the microactuators have been initiated by means of the initiation device according to the invention, this device may be reused, by fitting it onto a new microsystem. According to the invention, after the product has been used, only the microsystem has to be replaced. The initiation device may be reused by being fitted onto a new microsystem.

Owing to the relatively small size of the pyrotechnic microcharges, the fingers must be positioned precisely under each of the microcharges and must have a conductive portion proportional in size to that of the microcharges so as to obtain localized heating under each of the pyrotechnic microcharges. This is because, according to the invention, it is necessary to avoid heating too large a zone of the conductive layer and thus to prevent each conductive portion of a finger from being able to initiate a pyrotechnic microcharge of an adjacent microactuator when this initiation has not been commanded.

BRIEF DESCRIPTION OF DRAWINGS

The invention, with its features and advantages, will become more clearly apparent on reading the description given with reference to the appended drawings in which.

DETAILED DESCRIPTION

Microactuators and microsystems are described in patent application WO 02/088551 filed by the Applicant.

Throughout the description, the terms "pyrotechnic microcharges", "microactuators" and "microsystems" are used to denote objects of very small size, of the order of 1 mm or 1 micron, which in particular consequently introduce constraints as regards their fabrication and the operation of the device in which they are employed.

Figure 1:
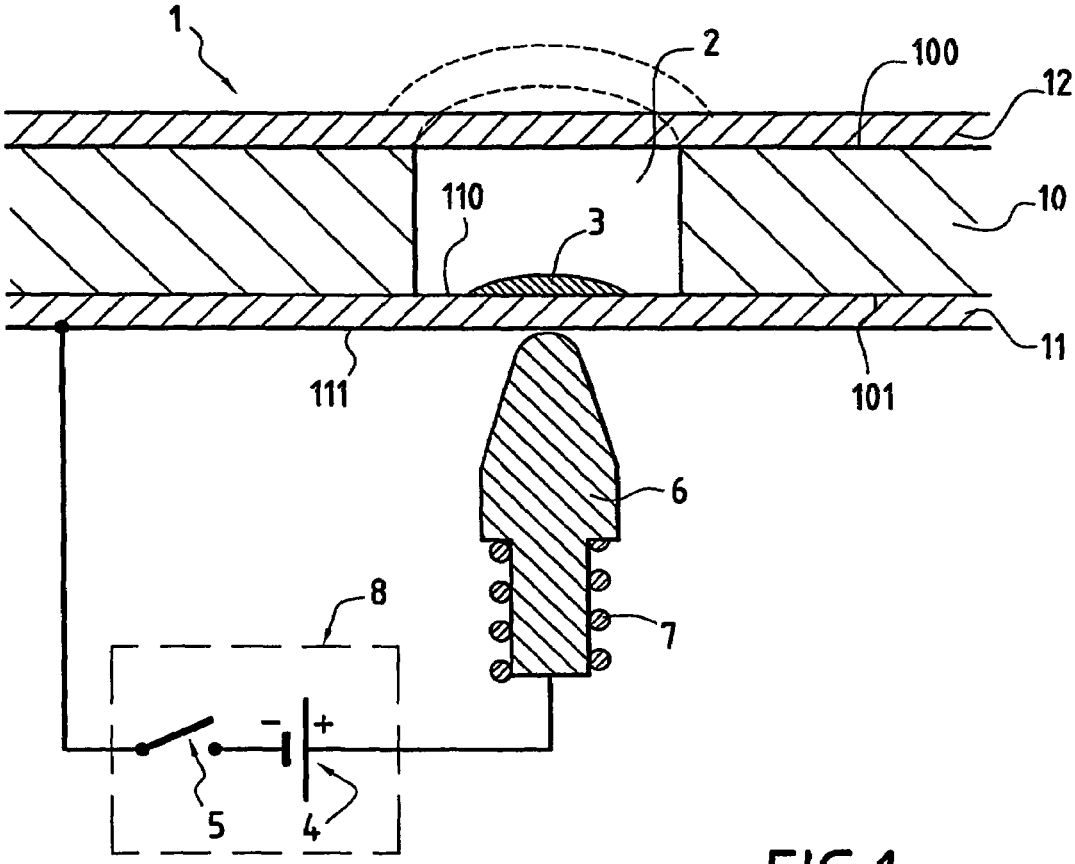
FIG. 1 shows schematically, in cross section, a device for initiating a pyrotechnic microactuator.

As is known, a pyrotechnic microactuator 1 comprises a chamber 2, for example of cylindrical shape, produced in a polycarbonate support. Said support results, for example as shown in FIG. 1, from a stack of sheets or layers joined together, for example by adhesive bonding, by laser welding or thermocompression welding, by hot lamination or by any other appropriate means. A single pyrotechnic microactuator 1, as shown in FIG. 1, comprises three superposed layers 10, 11, 12. The central layer 10 is pierced transversely by a hole which is covered by what is called the upper layer 12 fastened to a first face of the central layer, called the upper face 100, and by what is called the lower layer 11 fastened to what is called the lower face 101, on the opposite side from the upper face 100 of the central layer 10. The sidewalls of this hole therefore define, with the upper layer 12 and the lower layer 11, what is called the combustion chamber 2. The diameter of the combustion chamber 2 thus formed is for example 1 mm. A pyrotechnic microcharge 3 is placed in this combustion chamber 2. Preferably, the chamber 2 defines a hermetically sealed space.

The upper layer 12 consists of a deformable membrane joined to the upper face 100 of the central layer 10. This membrane will for example be made of a plastic and/or elastic material, for example PTFE (or Teflon, registered trademark) or made of a rubber or an elastomer.

According to the invention, the lower layer 11 is an electrically conductive layer, consisting for example of a metal foil, for example aluminum foil, which may for example be self-adhesive in order to be bonded to the central layer 10.

According to the invention, the pyrotechnic microcharge 3 is deposited in the combustion chamber 2 on the face of the conductive lower layer 11 which is in contact with the central layer 10. This face of the conductive layer 11 is called the upper face 110. The pyrotechnic microcharge 3 may be deposited for example in the form of a film, for example of discoid shape, having a thickness of less than 200 μm, for example between 1 μm and 100 μm.

According to the invention, the initiation of the pyrotechnic microcharge 3 contained in the combustion chamber 2 is carried out electrically. The microcharge 3 is initiated using a central control unit 8 comprising an electrical current generator 4 and a switch 5. A first terminal of the generator 4 is connected to an electrically conductive finger 6. This conductive finger 6 is mounted on a spring 7 and is fastened for example to a support (not shown in FIG. 1). The conductive finger 6 consists for example of a carbon or titanium electrode. A second terminal of the generator 4 is electrically connected to the conductive layer 11 of the microactuator 1, on which layer the pyrotechnic microcharge 3 is deposited. According to the invention, the free end, in other words the top, of the conductive finger 6 bears against the face 111 of the conductive layer 11 which is on the opposite side from that on which the pyrotechnic microcharge 3 is deposited, that is to say on the opposite side from its upper face 110. In addition, the conductive finger 6 is positioned so as to come into contact with the conductive layer 11 just beneath the point where the pyrotechnic microcharge 3 is deposited. The conductive finger 6 is held in contact against the conductive layer 11 thanks to the spring 7 on which the finger 6 is mounted. According to the invention, the central control unit 8, the conductive finger 6 and the conductive layer 11 therefore form, when the switch 5 is closed, a closed electrical circuit.

The circuit thus formed allows an electrical current to flow into the conductive finger 6, this current returning to the central control unit 8 via the conductive layer 11. The current flowing in the contact region between the conductive finger 6 and the conductive layer 11 causes local heating of the conductive layer 11 which, communicated to the pyrotechnic charge deposited on the opposite face 110, causes it to ignite. As is known, the combustion of the pyrotechnic microcharge 3 produces gases that expand into the chamber 2. The overpressure created in the chamber 2 causes the membrane 12 to deform. The membrane 12 will perform a certain function, according to the microsystem in which such a microactuator is used. For example, the membrane 12 will deform so as to close off a fluid microcircuit. If the chamber 2 is hermetically sealed, the gases emanating from the combustion of the pyrotechnic microcharge 3 remain in the chamber and the membrane 12 is thus kept in its deformed state through the action of these gases.

A microsystem is a miniaturized multifunctional device, the maximum dimensions of which do not exceed a few millimeters. In the case of a fluid microcircuit, a microsystem may for example be a microvalve or a micropump, and in the case of an electronic circuit, it may be a microswitch. The microactuators are produced in semiconductor supports, such as those for example made of silicon, when they are used for a microelectronic application. They may be designed in other materials, such as polycarbonate, for other applications and especially in the biomedical field.

Figure 2:
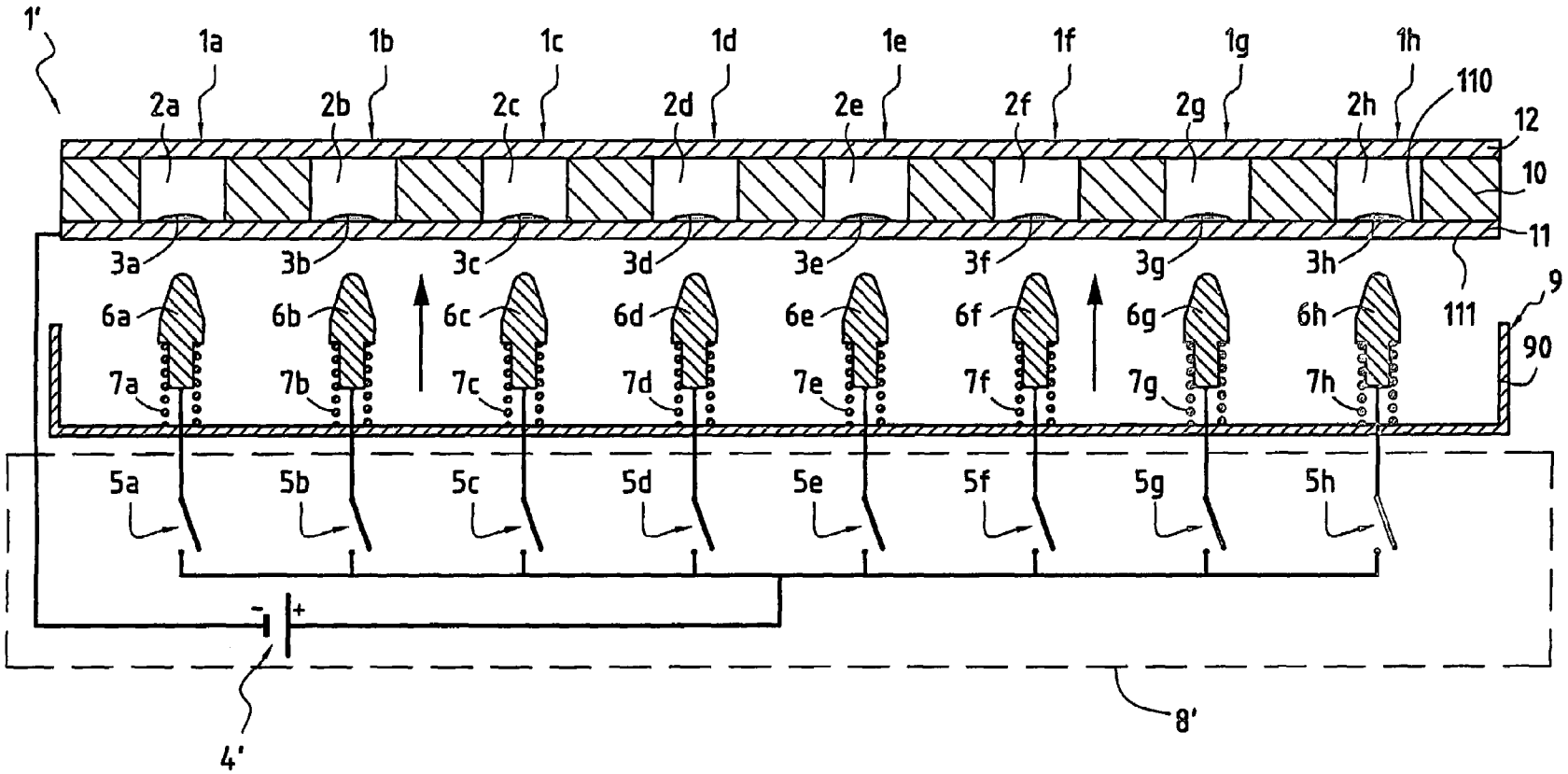
FIG. 2 shows schematically, in cross section, a microsystem made up of a plurality of microactuators, onto which an initiation device according to a first embodiment is fitted.

Referring to FIG. 2, a microsystem 1' according to the invention comprises, for example, a plurality of adjacent microactuators (1*a*, . . . , 1*h*) that are identical to the one described above with reference to FIG. 1. These microactuators (1*a*, . . . , 1*h*) are all formed in the same support by the stack of three layers 10, 11, 12 defined above, that is to say by the central layer 10 sandwiched between the membrane that forms the upper layer 12 and the electrically conductive lower layer 11. The combustion chamber (2*a*, . . . , 2*h*) of each of the microactuators (1*a*, . . . , 1*h*) is therefore bounded by the sidewalls of a hole that is formed through the central layer 10 and by the upper layer 12 forming the deformable membrane lying above and the electrically conductive lower layer 11 lying below. A pyrotechnic microcharge (3*a*, . . . , 3*h*), such as that described above, is deposited on the upper face 110 of the conductive lower layer 11 in each chamber (2*a*, . . . , 2*h*). The microactuators (1*a*, . . . , 1*h*) are for example spaced apart by a length of 2 mm.

According to a first embodiment of the invention shown in FIG. 2, an initiation device consists of several conductive fingers (6*a*, . . . , 6*h*) identical to that described above with reference to FIG. 1, these fingers standing up parallel to one another and perpendicular to a plane defined on a support element 9. Each of these fingers (6*a*, . . . , 6*h*) is mounted on a spring (7*a*, . . . , 7*h*) and is electrically connected to a central control unit 8'. The axes of the springs (7*a*, . . . , 7*h*) are parallel to one another and perpendicular to the plane defined on the support element 9. The fingers (6*a*, . . . , 6*h*) are electrically connected in parallel to one terminal of a current source 4' of the central control unit 8'. The central control unit 8' controls a plurality of switches (5*a*, . . . , 5*h*), each conductive finger (6*a*, . . . , 6*h*) being associated with one of these switches (5*a*, . . . , 5*h*). Thus, the central control unit 8' can, by closing certain switches (5*a*, . . . , 5*h*), select the microactuators (1*a*, . . . , 1*h*) to be activated. The central control unit 8' therefore includes selection means allowing it to select the switches to be closed according to the microactuators (1*a*, . . . , 1*h*) that it is necessary to activate. According to the invention, the support element 9 fits onto the microsystem 1' in such a way that a conductive finger (6*a*, . . . , 6*h*) is associated with each microactuator (1*a*, . . . , 1*h*) of the microsystem 1'. When the support element 9 is fitted onto the microsystem 1', the conductive fingers (6*a*, . . . , 6*h*) are kept in contact with the conductive lower layer 11 of the microsystem 1', each by means of their spring (7*a*, . . . , 7*h*) as explained above with reference to FIG. 1. The conductive fingers (6*a*, . . . , 6*h*) are placed on the support element 9 so that each is in contact with the lower face 111 of the lower layer 11, just beneath the pyrotechnic microcharge (3*a*, . . . , 3*h*), deposited on the opposite face 110, of the microactuator (1*a*, . . . , 1*h*) with which they are associated. The support element 9 includes, for example, a peripheral ring 90 that allows it to be fitted onto the microsystem 1'. The two elements are assembled, for example in the direction indicated by the arrows in FIG. 2, and the microsystem 1' and the support element 9 may be linked together for example by clip-fastening.

According to the invention, the central control unit 8' may be integrated into the support element 9 so as to constitute a complete initiation device that can be fitted onto the microsystem 1'.

According to the invention, each conductive finger (6*a*, . . . , 6*h*) in contact with the conductive lower layer 11, when said finger is selected by the central control unit 8', allows localized heating of the conductive lower layer 11 just under the microcharge (3*a*, . . . , 3*h*) with which it is associated, in order to initiate said microcharge (3*a*, . . . , 3*h*) and thus, through the action of the combustion gases, cause localized deformation, in the microactuator selected, of the upper layer 12 forming the membrane.

Figure 3:
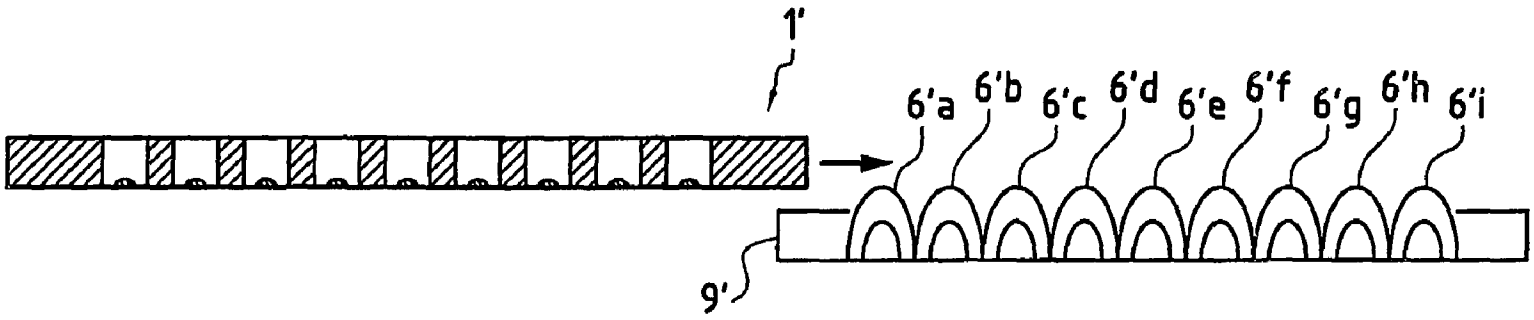
FIG. 3 shows schematically, in cross section, a microsystem made up of a plurality of microactuators, onto which an initiation device according to a second embodiment is fitted.
Figure 4:
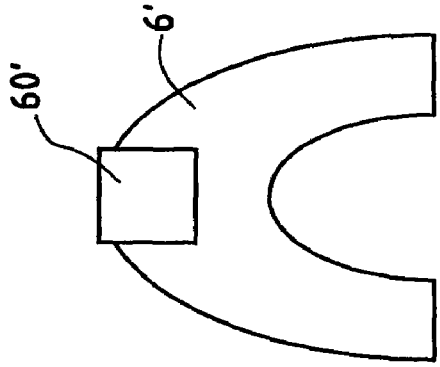
FIG. 4 shows schematically a conductive finger used in the initiation device that can be seen in FIG. 3.

According to a second embodiment of the invention shown in FIG. 3, an initiation device that can be fitted onto a microsystem 1' identical to that described with reference to FIG. 2 includes a support element 9' consisting of a thermoformed sheet of flexible material, for example an elastomer, thus forming a plurality of adjacent bosses (6', 6'*a*, . . . , 6'*i*). This type of sheet is for example of the type used in flexible keyboards for equipment. Formed on the top of each boss (6', 6'*a*, . . . , 6'*i*), for example by spraying, screen printing or pad printing, is a deposit 60' (FIG. 4) of an electrically conductive material, such as for example carbon. As in the first embodiment described with reference to FIG. 2, the electrically conductive deposits 60' of each boss (6', 6'*a*, . . . , 6'*i*) are connected in parallel to the central control unit (not shown in FIG. 3). Each of the bosses (6', 6'*a*, . . . , 6'*i*) thus forms a finger, the top of which is intended to bear against the conductive lower layer 11 of the microsystem 1' just under a pyrotechnic microcharge (3*a*, . . . , 3*h*). As in the previous embodiment, the conductive lower layer 11 is connected to one terminal of the central control unit. The flexibility of the material used to manufacture the support element 9' and the bosses (6', 6'*a*, . . . , 6'*i*) allows the bosses (6', 6'*a*, . . . , 6'*i*) to match the surface of the lower face 111 of the conductive lower layer 11 on which the pyrotechnic microcharges (3*a*, . . . , 3*h*) are deposited. As shown in FIG. 3, the microsystem 1' may for example be inserted by sliding it in the direction of the arrow relative to the initiation device according to the invention. Inserting the microsystem 1' into the initiation device compresses the elastomer bosses (6', 6'*a*, . . . , 6'*i*) of the support element 9'. The operation of such an initiation device is identical to that described with reference to FIG. 2.

According to the invention, what is therefore created in these various embodiments is an initiation device independent of the microactuator 1 or of the microsystem 1' with which it is associated. Thus, according to the invention, the initiation device can be reused once the microactuator 1 or the microsystem 1' has been used for the function for which it is intended.

According to the invention, the conductive lower layer 11 may for example consist of an aluminum foil with a thickness for example of between 20 μm and 150 μm. This thickness of the aluminum foil depends in particular on the intensity of the current flowing through it, and also on the nature and the quantity of pyrotechnic charge to be initiated. This is because it is found that the intensity of the current and the time during which it is flowing through the conductive layer have to be controlled so as to prevent perforation of the conductive layer 11. For example, in the case of the device shown in FIG. 1, it is possible to use, as conductive layer 11, an aluminum foil with a thickness of 70 μm through which, in order to ignite the pyrotechnic microcharge 3, a current of 4.5 amps is made to flow for a time of 0.2 seconds.

According to an alternative embodiment, the microcharge or microcharges (3, 3*a*, . . . , 3*h*) may be deposited not directly on the conductive layer 11 but may be located a sufficient distance therefrom to be able to be each ignited independently by means of the finger (6, 6*a*, . . . , 6*h* and 6', 6'*a*, . . . , 6'*i*) that is associated with them, by thermal conduction between the microcharges and the conductive layer 11. The thermal conduction may for example be via at least one thermally conductive layer deposited on the electrically conductive layer 11, on which thermally conductive layer the pyrotechnic microcharges (3, 3*a*, . . . , 3*h*) are deposited.

In one embodiment (not shown) of the microsystem 1' according to the invention, the chamber (2*a*, . . . , 2*h*) of some or each of the microactuators (1*a*, . . . , 1*h*) may for example be pierced by an orifice and communicate with the outside or with an ancillary chamber. This orifice is produced through the conductive lower layer 11 and is closed off by a pyrotechnic deposit placed in the chamber (2*a*, . . . , 2*h*), the external edge of which deposit is in contact with the conductive lower layer 11. According to the invention, combustion of this pyrotechnic deposit is brought about by locally heating the conductive layer 11 using a finger of an initiation device as described above. Thus, the combustion of this pyrotechnic deposit, while the chamber is under pressure and the membrane deformed, makes it possible to free the orifice and thus permits the gases to escape from the combustion chamber. Since the chamber is then no longer under pressure, the membrane, if it is elastic, deflates. According to the invention, dual-acting microactuators, allowing one action to be performed before returning to the initial position, are thus obtained.

It should be obvious to those persons skilled in the art that the present invention is capable of being embodied in many other specific forms without it departing from the field of application of the invention as claimed. Consequently, the present embodiments must be considered by way of illustration, but can be modified within the field defined by the scope of the claims appended hereto, and the invention must not be limited to the details given above.

The invention claimed is:

1. A device for the electrical initiation of at least one pyrotechnic microcharge, characterized in that it comprises a support element having at least one electrically conductive portion connected to a first terminal of a central control unit, a second terminal of said central control unit being intended to be electrically connected to an electrically conductive support, the microcharge being located at a sufficient distance from said conductive support to be able to be ignited by localized heating of the support, this heating being carried out via the conductive portion placed in contact with the conductive support, just beneath the pyrotechnic microcharge, wherein the conductive portion is produced at least at the top of a finger, said finger being positioned so as to bear via its top against the conductive support, and wherein the finger is mounted on a coil spring.

2. The device as claimed in claim 1, characterized in that the pyrotechnic microcharge is deposited on the conductive support.

3. The device as claimed in claim 1, characterized in that the pyrotechnic microcharge is separated from the support by at least one thermally conductive layer.

4. The device as claimed in claim 1, characterized in that the finger is an electrode made of carbon or made of titanium.

5. The device as claimed in claim 1, characterized in that the finger consists of a boss made of flexible material formed on the support element.

6. The device as claimed in claim 5, characterized in that the support element consists of a thermoformed sheet of flexible material in which said boss is formed, the boss forming a finger intended to bear via its top against the conductive support.

7. The device as claimed in claim 1, characterized in that, when the support element comprises a plurality of fingers, the electrically conductive portions are connected in parallel to the first terminal of the central control unit.

8. The device as claimed in claim 1, characterized in that, when the support element comprises a plurality of fingers, the position of the fingers can be adjusted.

9. A microactuator comprising an actuating element that can be actuated by the gases emanating from the combustion of at least one pyrotechnic microcharge, characterized in that said microcharge is located at a sufficient distance from a conductive layer to be able to be ignited by localized heating using an initiation device in accordance with that of claim 1, in which an electrically conductive portion is placed on said pyrotechnic microcharge in contact with the conductive layer, just beneath said pyrotechnic microcharge.

10. The microactuator as claimed in claim 9, characterized in that the pyrotechnic microcharge is deposited on a face of the conductive layer and in that the conductive portion is in contact with the face of the conductive layer on the opposite side to that on which the pyrotechnic microcharge is deposited.

11. The microactuator as claimed in claim 9, characterized in that the conductive layer consists of a metal film.

12. The microactuator as claimed in claim 11, characterized in that the film is made of aluminum.

13. The micro actuator as claimed in claim 12, characterized in that the aluminum film has a thickness of between 20 and 150 μm.

14. The microactuator as claimed in claim 12, characterized in that the aluminum film has a thickness of 70 μm.

15. The microactuator as claimed in claim 9, characterized in that the microactuator is produced by assembling superposed layers.

16. The microactuator as claimed in claim 15, characterized in that the microactuator includes a cavity formed by the multilayer assembly, in which cavity at least one pyrotechnic microcharge is placed, said cavity being closed by a layer constituting a deformable membrane.

17. A micro system, characterized in that it comprises a support for a plurality of adjacent microactuators in accordance with that of claim 9, the pyrotechnic microcharges of the microactuators being located at a sufficient distance from the conductive layer to be able to be ignited, each independently, by heating using the initiation device whose support element is fitted onto the support for the microactuators, said initiation device comprising a plurality of conductive portions connected in parallel to the first terminal of the central control unit, a conductive portion being placed on each of the pyrotechnic microcharges, in contact with the conductive layer, just beneath each of the pyrotechnic microcharges.

18. The micro system as claimed in claim 17, characterized in that the microactuators are all formed from an assembly of the same layers.

* * * * *